United States Patent [19]

Jolliffee

[11] Patent Number: 4,930,677

[45] Date of Patent: Jun. 5, 1990

[54] CONCRETE CONNECTOR

[76] Inventor: Michael J. A. H. Jolliffee, 13 Buckingham St., Cambridge, Mass. 02138

[21] Appl. No.: 194,522

[22] Filed: May 16, 1988

[51] Int. Cl.[5] ..... B23K 28/02

[52] U.S. Cl. ..... 228/120; 52/583; 52/741; 404/56; 404/69

[58] Field of Search ..... 52/583, 587, 741, 747, 52/748; 404/56, 69; 228/120, 228

[56] References Cited

U.S. PATENT DOCUMENTS

| | | | |
|---|---|---|---|
| 976,183 | 11/1910 | Jones | 52/583 |
| 1,308,306 | 7/1919 | Stewart . | |
| 1,334,600 | 3/1920 | Eades . | |
| 1,334,672 | 3/1920 | Noullet . | |
| 1,912,920 | 6/1933 | Saunders | 52/587 |
| 2,136,431 | 11/1938 | Gardaile | 52/587 |
| 2,537,715 | 1/1951 | Stead | 52/587 |
| 2,844,024 | 7/1958 | McDonald . | |
| 3,239,913 | 3/1966 | Richmond | 52/587 |
| 3,508,369 | 4/1970 | Tennison . | |
| 3,555,763 | 1/1971 | Bloxom | 52/583 |
| 3,780,480 | 12/1973 | Cvijanovic . | |
| 3,868,802 | 3/1975 | Schubach | 52/583 |
| 3,993,341 | 11/1976 | Bentley . | |
| 4,023,324 | 3/1977 | Majeske | 52/741 |
| 4,554,724 | 11/1985 | Bantz | 52/741 |

FOREIGN PATENT DOCUMENTS 359429 11/1931 United Kingdom .

OTHER PUBLICATIONS

Technical Bulletin Pretopped Prestressed Parking Structures: Leakage Problems at Welds, Nov. 1987.

*Primary Examiner*—Nicholas P. Godici
*Assistant Examiner*—Michael William Starkweather

[57] ABSTRACT

A connector for a concrete structure including two generally flat plates connected together along one edge to form an elongated structure having substantially an L-shaped cross section. One plate has an opening sized to allow unset concrete to flow through the opening and to hold the plate firmly within the concrete when it is set. When this plate is held within the concrete, the other plate protrudes from the concrete and is available for connection with another such connector by direct welding or clamping of the two plates together.

5 Claims, 1 Drawing Sheet

CONCRETE CONNECTOR

BACKGROUND OF THE INVENTION

This invention relates to connecting devices for concrete panels, and especially to connection of precast concrete double tee floor panels.

Precast concrete double tee floor panels are used for forming floors and roofs in garages and other buildings. They can be placed adjacent to each other with no further finished concrete being required. Traditionally, they are connected by installing weld plates attached to reinforcing steel within each panel. The weld plates are positioned adjacent to the edge of the panel and are connected by welding one side of a round bar to each weld plate.

Technical Bulletin (November 1987, issued by Peterson Elastomers, Inc., Engineering and Manufacturing Division of the Harry S. Peterson Companies, 4150 South Lapeer Road, Pontiac, Mich. 48057) describes an alternate means for fastening such floor panels by use of weld plates positioned at an angle within the concrete panel. A round bar is again welded to each plate. This bulletin describes problems with these plates and potential solutions to these problems. In particular, it states that overheating of the plates during welding should be avoided, or cracking of the panels may result.

SUMMARY OF THE INVENTION

In a first aspect the invention features, a connector for a concrete structure including two generally flat plates connected together along one edge to form an elongated structure having substantially an L-shaped cross section. One plate has an opening sized to allow unset concrete to flow through the opening and to hold the plate firmly within the concrete when it is set. When this plate is held within the concrete, the other plate protrudes from the concrete and is available for connection with another such connector by direct welding or clamping of the two plates together.

In a second aspect the invention features a concrete structure having two generally flat plates connected together along one edge to form an elongated structure having substantially an L-shaped cross section. One plate is positioned within the concrete when it is set and the other plate protrudes from the concrete and is available for connection with another such connector by direct welding or clamping of the two plates together.

In a related aspect the invention features a method for connection of two concrete structures including the following steps: (a) providing a connector including two generally flat plates connected together along one edge to form an elongated stucture having substantially an L shaped cross section; (b) positioning one such connector within each of two of the concrete structures such that one plate is held within the concrete structure and the other plate protrudes from the structure; (c) positioning the concrete structures to bring the two protruding plates in close proximity; and (d) fastening the two plates together In preferred embodiments, the fastening includes direct welding, clamping or both welding and clamping.

This invention provides a connector and method for connection of concrete panels which allows the required structural resistance to be attained, allows some movement in a direction in which the concrete panels are laid, and either eliminates the requirement for welding or reduces the intensity of heat at the point where the connector is in contact with concrete. Thus, the invention allows the prevention of weld cracks and water leakage related to these cracks.

Other features and advantages of the invention will be apparent from the following description of the preferred embodiments thereof, and from the claims.

DESCRIPTION OF THE PREFERRED EMBODIMENT

The drawings will first briefly be described.

DRAWINGS

STRUCTURE

Figure 1:
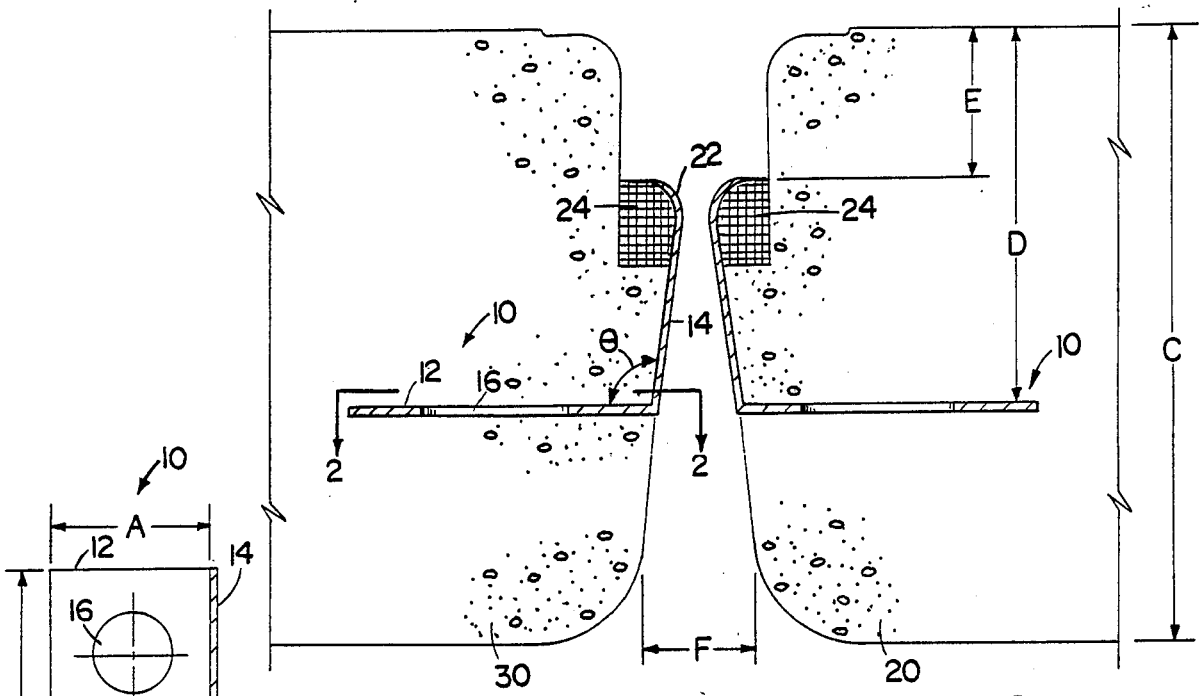
FIG. 1 is a transverse sectional view through two concrete panels each having a connector of the invention.
Figure 2:
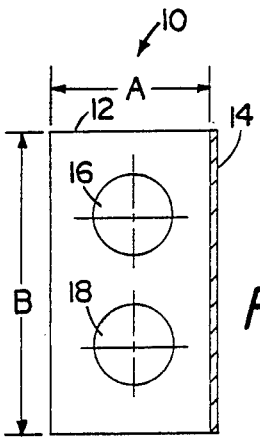
FIG. 2 is a surface view of a concrete connector of the invention shown at 2—2 in FIG. 1.

Referring to FIGS. 1 and 2, connector 10 is formed of stainless steel, or other metal, as a generally L-shaped plate. Connector 10 has a lower portion or leg 12, and an upper portion or foot 14. Leg 12 has two circular apertures 16, 18 with a diameter of about 1 inch. Leg 12 has a width A of about 2 inches and a length B of about 4 inches. Foot 14 is applied at an angle $\theta$ of about 95° to leg 12.

Figure 3:
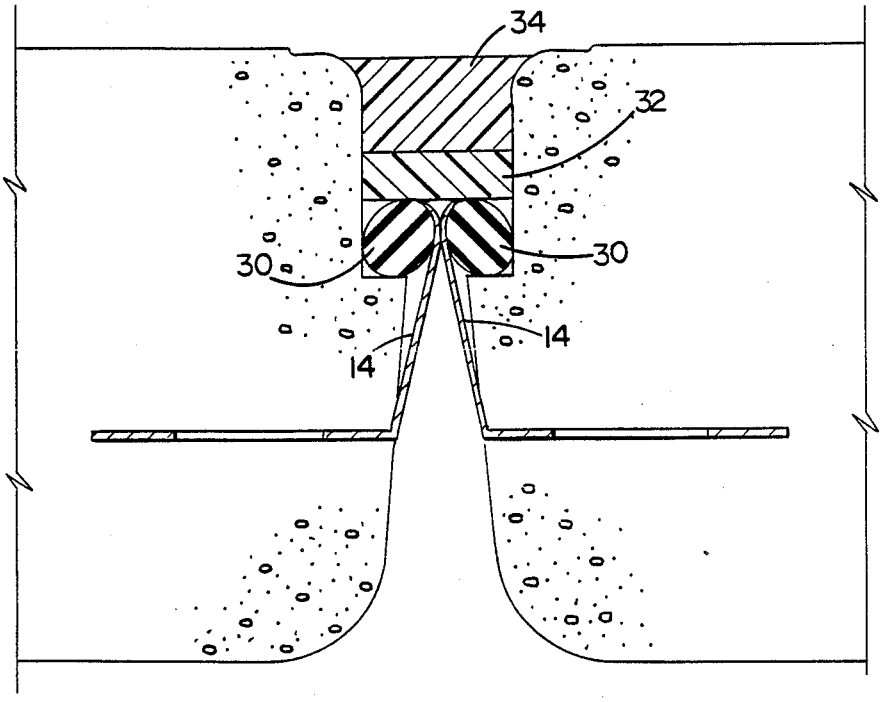
FIG. 3 is a transverse sectional view through two concrete panels connected by connectors of the invention.

Referring to FIG. 1, concrete panel 20 is formed by standard procedures with connector 10 embedded therein. Apertures 16, 18 in leg 12 allow concrete to flow through connector 10 and thus permit interconnection of concrete through connector 10. Foot 14 of the connector is placed against concrete form 20 and is exposed to the surface of the concrete when the precast concrete product is removed from the form. Although foot 14 is shown with a bent or rounded edge 22, this edge may be straight, depending upon the method of connection of the elements which will be selected. During casting, a Styrofoam blocking material 24 is positioned within the mold and is removed after casting. This allows foot 14 to be readily moved from the side of form 20, as shown in FIG. 3. The overall width of concrete panel 20 is C about 4 inches and connector 10 is placed a distance D of about $2\frac{1}{2}$ inches from the other surface of concrete block 20 with the upper part of foot 14 a distance E of about 1 inch from the surface of concrete block 20.

Use

Referring to FIG. 1, two concrete blocks 20, 30 are positioned to lie a distance F about $\frac{3}{4}$ inch apart. The two connectors 10 are then clamped together using a hydraulic press and spot-welded at one or more locations about $1\frac{1}{2}$ inches apart, or simply mechanically crimped together with a U-shaped thin piece of metal. Alternatively, arc-welding may be used to join the two plate connectors in a single weld pass.

Referring to FIG. 3, feet 14 are welded to provide a shear capacity of at least 2000 lbs. Neoprene rods 30 are positioned on either side of the connectors, or caulking is applied to resist the lateral forces induced by a vertical shear between the adjacent panels. Preferably, polyethylene 32 or other backer tape or rod is applied above rods 30, as shown in FIG. 3; and polyurethane 34, or other caulking applied above to form a water tight connection.

Other embodiments are within the following claims.

I claim:

1. A concrete structure comprising a connector having two generally flat plates connected together along one edge to form an elongated structure having substantially an L-shaped cross section wherein when one said plate is held firmly within said concrete, said other plate protrudes from said concrete, wherein one portion of said other plate is completely removed on all sides from said concrete, and another portion of said plate lies close to said concrete, and said other plate is available for connection with another said connector by direct welding or clamping of said other plate to said other connector while said other plate is moved away from said concrete.

2. A method for connection of two concrete structures, comprising the steps of:

(a) providing two generally flat plates connected together along one edge to form an elongated structure having substantially an L-shaped cross section wherein when one said plate is held firmly within said concrete, said other plate protrudes from said concrete, and is movably away from contact with the surface of said concrete structure, and is available for connection with another said connector by direct welding or clamping of said other plate to said other connector while said other plate is completely removed on all sides from said concrete, (b) positioning one said connector within each of said two structures such that said other plate protrudes from said structure and is completely removed on all sides from said concrete, (c) positioning said structures to bring said other plates into close proximity; and fastening said other plates together while completely removed on all sides from said concrete.

3. The method of claim 2, further comprising the step of installing a rod material or caulking adjacent said other plate to resist the lateral forces on said structure.

4. The method of claim 2 wherein said fastening comprises direct welding, clamping, or both welding and clamping.

5. The structure of claim 1 wherein one said plate comprises an opening sized to allow unset concrete to flow through said opening and to hold said one plate firmly within said concrete when set.

* * * * *

UNITED STATES PATENT AND TRADEMARK OFFICE

CERTIFICATE OF CORRECTION

PATENT NO. : 4,930,677

DATED : June 5, 1990

INVENTOR(S) : Michael J.A.H. Jolliffe

It is certified that error appears in the above-identified patent and that said Letters Patent is hereby corrected as shown below:

ON TITLE PAGE:

Correct the name of the patentee "Michael J.A.H. Jolliffee" to read --Michael J.A.H. Jolliffe--.

Col. 1, line 54; insert a hyphen between "L shaped".

Col. 1, line 60; insert --.-- at end of line.

Col. 3, line 26; change "movably" to --movable--.

Signed and Sealed this

Twelfth Day of May, 1992

*Attest:*

DOUGLAS B. COMER

*Attesting Officer*

*Acting Commissioner of Patents and Trademarks*